US010913628B2

(12) United States Patent
Widsten et al.

(10) Patent No.: US 10,913,628 B2
(45) Date of Patent: Feb. 9, 2021

(54) DESKEWING MEDIA

(71) Applicant: NCR Corporation, Duluth, GA (US)

(72) Inventors: Benjamin T. Widsten, Kitchener (CA); Jason Michael Gillier, Waterloo (CA)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/136,395

(22) Filed: Apr. 22, 2016

(65) Prior Publication Data

US 2017/0305698 A1 Oct. 26, 2017

(51) Int. Cl.

*B65H 9/16* (2006.01)
*B65H 9/20* (2006.01)
*B65H 9/14* (2006.01)

(52) U.S. Cl.

CPC ..... *B65H 9/20* (2013.01); *B65H 9/14* (2013.01); *B65H 9/166* (2013.01); *B65H 2403/92* (2013.01); *B65H 2511/21* (2013.01); *B65H 2553/41* (2013.01)

(58) Field of Classification Search

CPC ... B65H 7/06; B65H 7/08; B65H 7/10; B65H 9/16; B65H 9/163; B65H 9/166; B65H 2301/331; B65H 2301/3613; B65H 2301/542; B65H 2511/11; B65H 2511/16; B65H 2511/214; B65H 2511/216; B65H 2511/242; B65H 2601/272; B65H 2701/1912

USPC ..... 271/227, 248, 250, 251

See application file for complete search history.

(56) References Cited

U.S. PATENT DOCUMENTS

| | | | | |
|---|---|---|---|---|
| 6,817,609 | B2 * | 11/2004 | Halvonik | B65H 9/00 271/227 |
| 7,445,208 | B2 * | 11/2008 | Onodera | B65H 9/006 271/226 |
| 7,648,138 | B2 * | 1/2010 | Hayashi | B65H 9/166 271/227 |
| 7,731,188 | B2 * | 6/2010 | deJong | B65H 7/02 271/264 |
| 8,113,511 | B2 * | 2/2012 | Kallin | B65H 9/166 271/228 |
| 8,789,828 | B2 * | 7/2014 | Wang | B65H 9/106 271/251 |
| 8,944,433 | B2 * | 2/2015 | Fehrenbach | B65H 5/062 194/206 |
| 9,676,577 | B2 * | 6/2017 | Schoenmakers | B65H 7/10 |
| 9,969,583 | B2 * | 5/2018 | Widsten | B65H 5/062 |
| 2004/0094891 | A1 * | 5/2004 | Trovinger | B65H 7/08 271/227 |

* cited by examiner

*Primary Examiner* — Howard J Sanders

(74) *Attorney, Agent, or Firm* — Schwegman, Lundberg & Woessner

(57) ABSTRACT

A deskew module of a valuable media depository is selectively controlled to operate in two deskew modes of operation. One deskew mode of operation selectively activates a single angle drive idler in a first cell while simultaneously activating a single straight drive idler in second cell, which forces the media to self-align against an edge of the deskew module for exiting the deskew module deskewed.

6 Claims, 11 Drawing Sheets

DESKEWING MEDIA

BACKGROUND

Currency recyclers and depositories generally include note separators to separate stacks of notes before being processed by a deskew module that deskews each note for further downstream processing, such as imaging.

Typically, bunches of notes or stacks experience difficulty during separation within the depositories or recyclers. This can occur for a variety of reasons. For example, the notes may be too crisp or too limp. Crisp notes pose a particular problem during separation within a currency depository or recyclers because crisp notes, such as checks experience a high degree of friction between sheets of the checks. Furthermore, because these checks are smooth and undamaged, rollers and belts used to separate the stack of checks struggle with gripping individual checks.

In addition to new checks, depository or recyclers separation equipment must also effectively deal with poor quality currency, which is typically very limp and folds or crumples easily in transport within the depository or recyclers.

Conventional deskew modules experience similar problems as that which separators do but within the context of orienting each note properly for downstream imaging operations. These conventional deskew modules ensure that a leading edge of the media makes first contact with the deskew track datum. This is generally acceptable for good quality media. However, limp, worn, humid, or otherwise difficult to deskew media often buckles when the leading half of the media contacts the deskew track datum. The buckle slows one side of the media causing it to twist and turn and fold, which may result in severe damage to the media. When this happens, the media can no longer be deskewed and could result in a fatal media jam within the deskew module when the deskew module attempts to eject the media, and further precipitates a service call to a service engineer to clear the jam.

SUMMARY

In various embodiments, methods for deskewing media within a valuable media depository and a valuable media depository are provided.

According to an embodiment, a method for deskewing valuable media is presented. Specifically, receipt of an item of media is detected within a deskew module. Next, the deskew module is activated within a first deskew mode of operation or a second deskew mode of operation based at least in part on the receipt of the item within the deskew module.

DETAILED DESCRIPTION

Figure 1A:
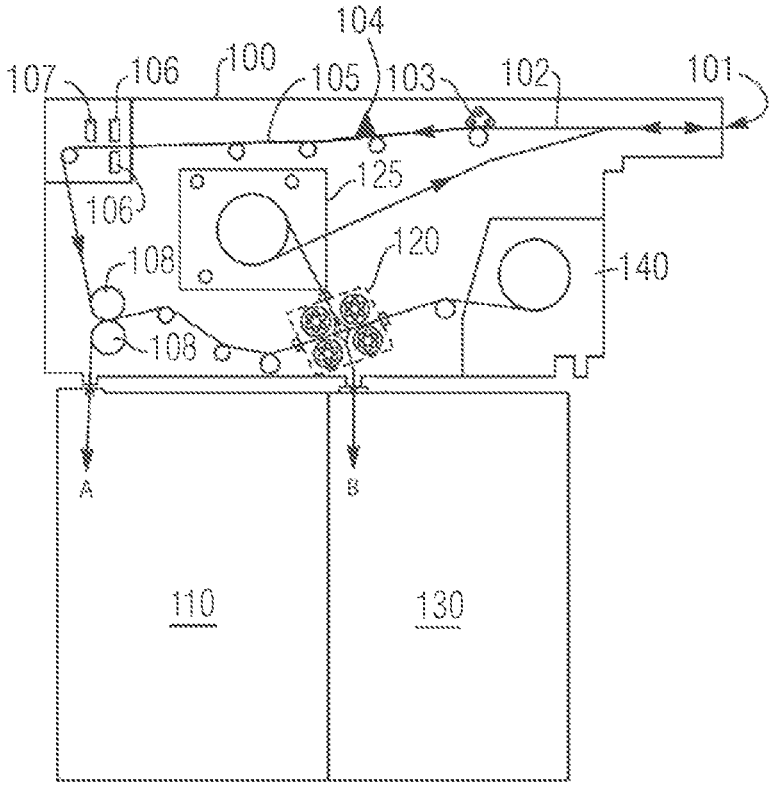
FIG. 1A is a diagram depicting a deposit module of a Self-Service Terminal having a deskew module, according to an example embodiment.

FIG. 1A is a diagram depicting a one-sided view of a valuable media depository 100, according to an example embodiment (also referred to as a deposit module). It is to be noted that the valuable media depository is shown with only those components relevant to understanding what has been added and modified to a conventional depository for purposes of providing deskewing of limp media fed into the depository 100.

The depository 100 is suitable for use within an Automated Teller Machine (ATM), which can be utilized to process deposited banknotes and checks (valuable media as a mixed bunch if desired). The deposit module 100 has an access mouth 101 (media or document infeed) through which incoming checks and/or banknotes are deposited or outgoing checks and/or banknotes are dispensed. This mouth 101 is aligned with an infeed aperture in the fascia of the ATM in which the depository 100 is located, which thus provides an input/output slot to the customer. A bunch (stack) of one or more items (valuable media) is input or output. Incoming checks and/or banknotes follow a first transport path 102 away from the mouth 101 in a substantially horizontal direction from right to left shown in the FIG. 1A. They then pass through a separator 103 and from the separator to a novel deskew module 104 (discussed in detail below with reference to the FIGS. 1B-1G) along another pathway portion 105, which is also substantially horizontal and right to left. The items are now de-skewed and aligned for reading by imaging cameras 106 and a Magnetic Ink Character Recognition (MICR) reader 107.

Items are then are directed substantially vertically downwards to a point between two nip rollers 108. These nip rollers cooperate and are rotated in opposite directions with respect to each other to either draw deposited checks and/or banknotes inwards (and urge those checks and/or banknotes towards the right hand side in the FIG. 1A), or during another mode of operation, the rollers can be rotated in an opposite fashion to direct processed checks and/or banknotes downwards in the direction shown by arrow A in the FIG. 1A into a check or banknote bin 110. Incoming checks and/or banknotes, which are moved by the nip rollers 108 towards the right, enter a diverter mechanism 120. The diverter mechanism 120 can either divert the incoming checks and/or banknotes upwards (in the FIG. 1A) into a re-buncher unit 125, or downwards in the direction of arrow B in the FIG. 1A into a cash bin 130, or to the right hand side shown in the FIG. 1A into an escrow 140. Items of media from the escrow 140 can selectively be removed from the drum and re-processed after temporary storage. This results in items of media moving from the escrow 140 towards the left hand side of the FIG. 1A where again they will enter the diverter mechanism 120. The diverter mechanism 120 can be utilized to allow the transported checks and/or banknotes to move substantially unimpeded towards the left hand side and thus the nip rollers 108 or upwards towards the re-buncher 125. Currency notes from the escrow can be directed to the re-buncher 125 or downwards into the banknote bin 130.

As used herein, the phrase "valuable media" refers to media of value, such as currency, coupons, checks, negotiable instruments, value tickets, and the like.

For purposes of the discussions that follow with respect to the FIGS. 1A-1H, "valuable media" is referred to as currency and the "valuable media depository" is referred to as a "depository." Additionally, valuable media may be referred to as a "document" herein.

Moreover, the phrase "damaged media" as used herein refers to any valuable media/document that is torn, limp, worn, humid, or otherwise difficult to deskew within the depository 100 by the deskew module 104.

It is also noted that some dimensions and measurements may be implicitly illustrated with the discussions of the FIGS. 1B-1G, these dimensions and measurements may be altered without departing from the novel teachings presented herein for deskewing damaged media within a valuable media depository.

Figure 1B:
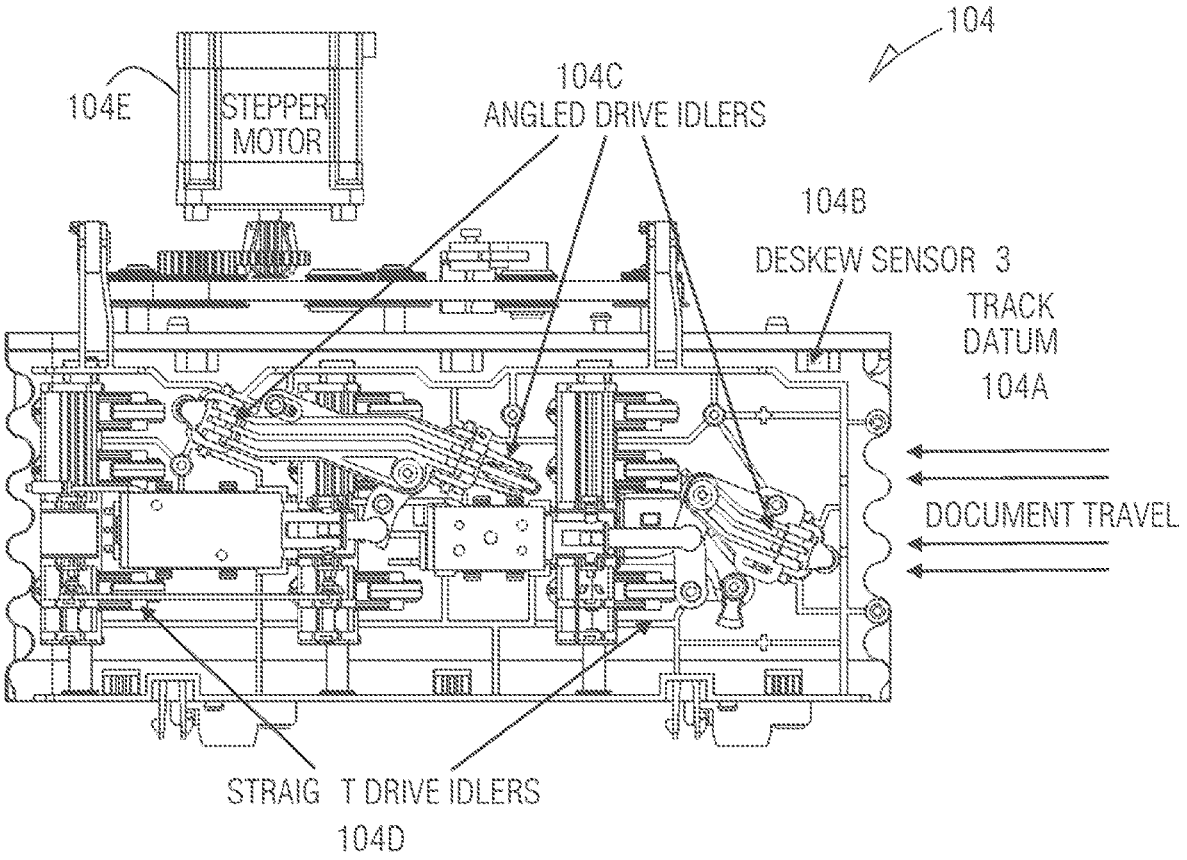
FIG. 1B is a diagram depicting features of a deskew module from a top-bottom perspective, according to an example embodiment.

FIG. 1B is a diagram depicting features of the deskew module 104 for a top-bottom perspective, according to an example embodiment.

Only those components of the deskew module 104 that are necessary for understanding the teachings presented herein are labeled in the FIGS. 1B-1G that follow.

The deskew module 104 includes a track datum 104A representing the starting point of the track associated with the transport path 102 of the valuable media depository 100 that first enters the deskew module 104 and carrying a single currency note (cash, checks, valuable media, document, etc.) as separated by the separator 103. The deskew module 104 also includes three deskew sensors 104B, a plurality of angled drive idlers 104C, a plurality of straight drive idlers 104D, and a stepper motor 104E that drives the idlers 104C and 104D.

During conventional deskew processing, a conventional deskew module would engage all straight drive idlers upon detection of the media entering on the track datum and then engage all the angled drive idlers at once while disengaging all the straight line idlers. However, with damaged media, the orientation of the damaged media is often off center or skewed upon entering the deskew module, this causes the damage media to twist and turn and as discussed above can result in a media jam within the deskew module. Conventionally, the operation of the deskew module depending upon the orientation of the media when entering the deskew module. The teachings presented herein provide for a different mode of operation within the deskew module 104 for damaged media to more optimally alleviate and mitigate deskewing damaged media.

Figure 1C:
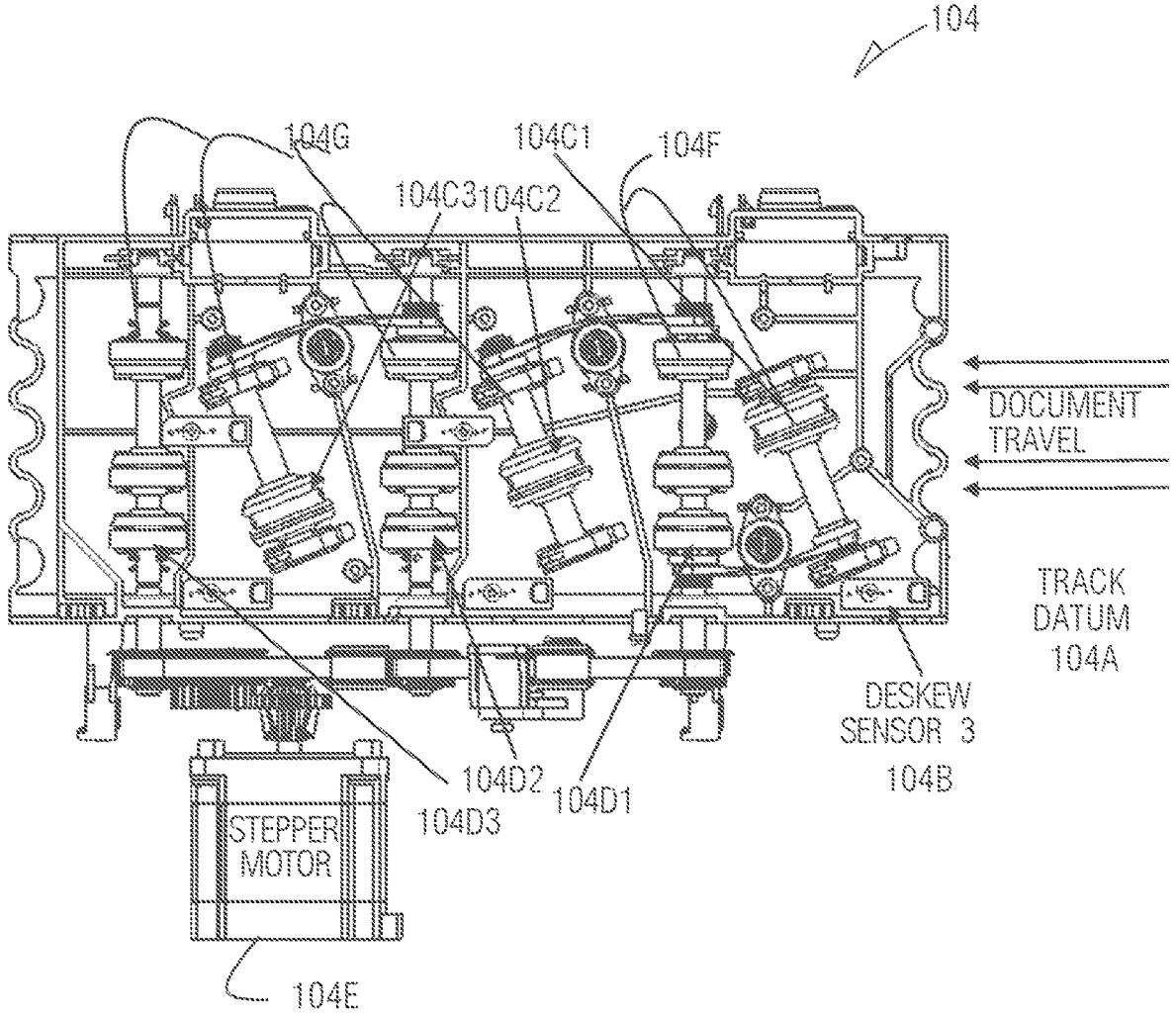
FIG. 1C is a diagram depicting features of a deskew module for a bottom-top perspective, according to an example embodiment.

FIG. 1C is a diagram depicting features of a deskew module 104 for bottom-top perspective, according to an example embodiment.

The deskew module 104 includes a first cell 104F that includes angled drive idlers 104C1 and one straight drive idler 104D1. The second cell 104G includes two angled drive idler 104C2 and 104C3 and two straight drive idlers 104D2 and 104D3. When the straight drive idlers 104D1-D3 are activated the angle drive idlers 104C1-C3 are inactive. However, this activation and deactivation can occur independent within each cell 104F and 104G; so, when cell 104F has angled drive idler 104C1 deactivated, straight drive idler 104D1 is inactive but in cell 104G angled drive idlers 104C2 and 104C3 can be active with straight drive idlers 104D2 and 104D3 inactive (the opposite can be true as well). The cell 104F and 104G is used to illustrate the groupings of the idlers (104F having 104C1 and 104D1 and 104G having 104C2-C3 and 104D2-D3).

A circuit board within the valuable media depository 100 includes component circuitry and firmware programmed to selectively activate and deactivate the idlers 104C1-C3 and 104D1-D3 within the cells 104F and 104G. This is based on readings captured from the three deskew sensors 104B and other optical sensors located throughout the deskew module 104 (and provide timing information as to when those sensors are blocked by media and not blocked by media being processed within the deskew module 104). The firmware and component circuitry may be referred to herein as a deskew controller (or just "controller").

Figure 1D:
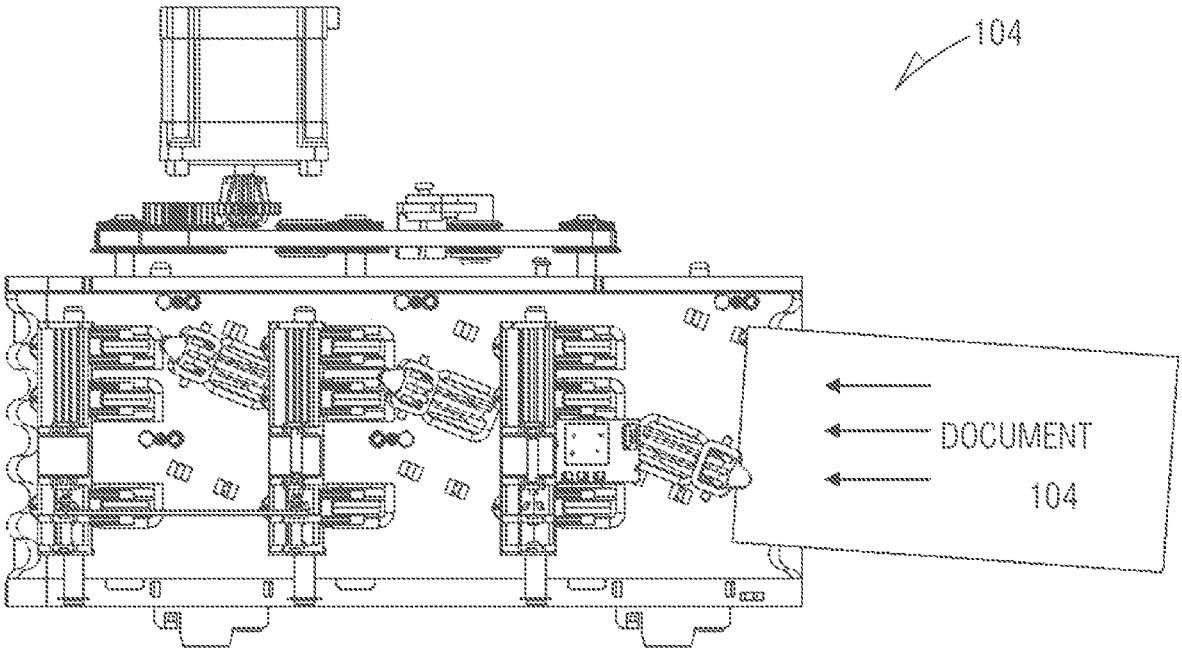
FIG. 1D is a diagram depicting an initial media fed into a deskew module, according to an example embodiment.

FIG. 1D is a diagram depicting an initial media fed into a deskew module 104, according to an example embodiment.

With the components and arrangements of the deskew module 104 illustrated (necessary for understating the teachings presented herein), FIGS. 1D-1G now illustrate the operation of the deskew module 104, as those components are controlled by the controller through readings processed by the controller and received from the sensors including the three depicted deskew sensors 104B. The depicted operation in the FIGS. 1D-1G is for a damaged media mode of operation for the deskew module 104. Other modes of operation are discussed below and include a retry or backup mode and a normal mode.

Selection by the controller of the mode of operation for the damaged media and normal modes of operation for the deskew module 104 is based on length measurements for the media being processed. The length is determined by the controller and based on timing of optical sensors indicating when covered and uncovered as the media moves through the deskew module 104. The length of the media determined by the controller is the compared with predefined lengths or ranges of lengths configured in the controller or the predefined lengths or ranges of lengths are passed as operation parameters to the controller. The comparison of the determined length against the predefined length or ranges of lengths causes the controller to either activate the damaged media mode of operation or the normal mode of operation within the deskew module 104. In an embodiment, the controller activates the deskew module 104 in a damaged media mode of operation when the length of the media is within a configured range of a length expected for a length of a currency (media) being processed by the media depository 100 (the length of U.S. cash is different from the length of Euros, for example, such that for a U.S. ATM (a type of media depository) handles cash whereas a European ATM handles Euros). In an embodiment, the configured range of a length is plus or minus approximately 5 mm.

Conventionally, deskew modules operate in just a normal mode of operation (all drive idlers activated together and at once when processing media). As discussed herein, the deskew module 104 can (through the controller) activate the deskew module 104 in multiple modes of operation (as discussed above) and this is done dynamically as individual items of media are processed in the deskew module 104. That is, a conventional deskew module activates all straight drives of the deskew module at once or all angled drives at once based on the preconfigured setting of the deskew module for the length of currency being handled by that deskew module (EURO, U.S., etc.). This single mode for conventional deskew module is also applied to any check processing as well. Conversely, as discussed here, the deskew module 104 can operate in a currency mode of operation (for the deskew module's configured currency type that it is handling (Euro, U.S., etc.) and a check mode of operation. The currency mode of operation is also different from the conventional single mode because the straight drives and angled drives are activated in pairs, such that an angle drive is activated when at the same time straight drives are activated. The currency mode is also optimized and performs better than the conventional single mode against damaged media. The selection of the currency mode and check mode is achieved by a dynamic determined length of the media item being processed within the deskew module 104 (which is also different from conventional approaches because there is no length determination and in all conventional approaches the preconfigured length setting is used for a single mode of operation regardless of whether the media is currency or a check).

Again, the FIGS. 1D-1G illustrate a controller determined and activated damaged media mode of operation for the deskew module 104 that is processing/handling a document 104H (document can be used synonymously with media or valuable media herein as previously stated). It is to be noted, the novel deskew module 104 having the novel controller can also operate in the conventional normal mode of operation. However, the controller can dynamically switch between multiple modes of operation from one document to another document based on the processing discussed above.

The retry or backup mode of operation is discussed below after the FIG. 1G, which also varies from how conventional deskew modules perform a retry on a document that was not fully deskewed.

Continuing with the present illustration of FIG. 1D within the context of the damaged media mode of operation for the deskew module 104 when handling a document 104H.

The FIG. 1D shows a document 104H entering the deskew module 104 on the track datum 104A.

Figure 1E:
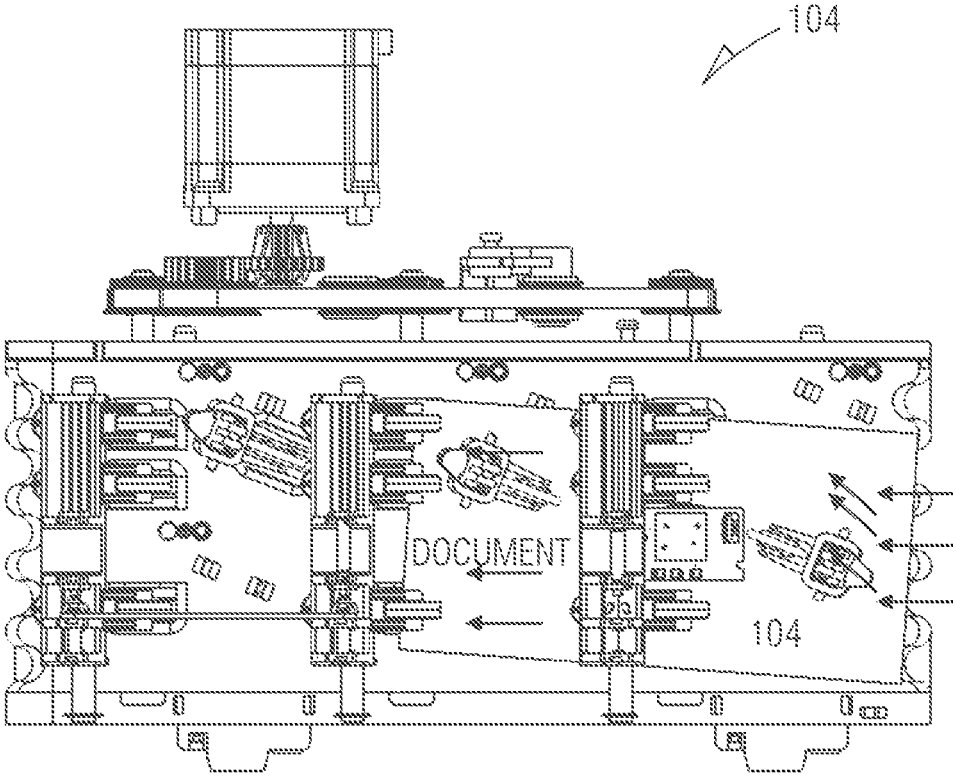
FIG. 1E is a diagram depicting initial deskewing of the media once received into the deskew module, according to an example embodiment.

FIG. 1E is a diagram depicting initial deskewing of the media once received into the deskew module, according to an example embodiment.

When the document 104H enters the deskew module 104 (in the dynamically determined damaged mode of operation) along the track datum 104A, the controller deactivates straight idler 104D1 in cell 104F with the angle idlers 104C1 of cell 104F being activated. Simultaneously, the controller deactivates the angle idler 104C2-C3 with the straight idlers 104D2-D3 being activated in cell 104G.

The linear direction of the straight drive idlers 104D1-D3 being 180 degrees straight through the deskew module 104 when activated whereas the angled pulling direction of the angle drive idlers 104C1-C3 is at an angle that is less than 180 degrees and in the direction of a top edge of the deskew module 104.

Figure 1F:
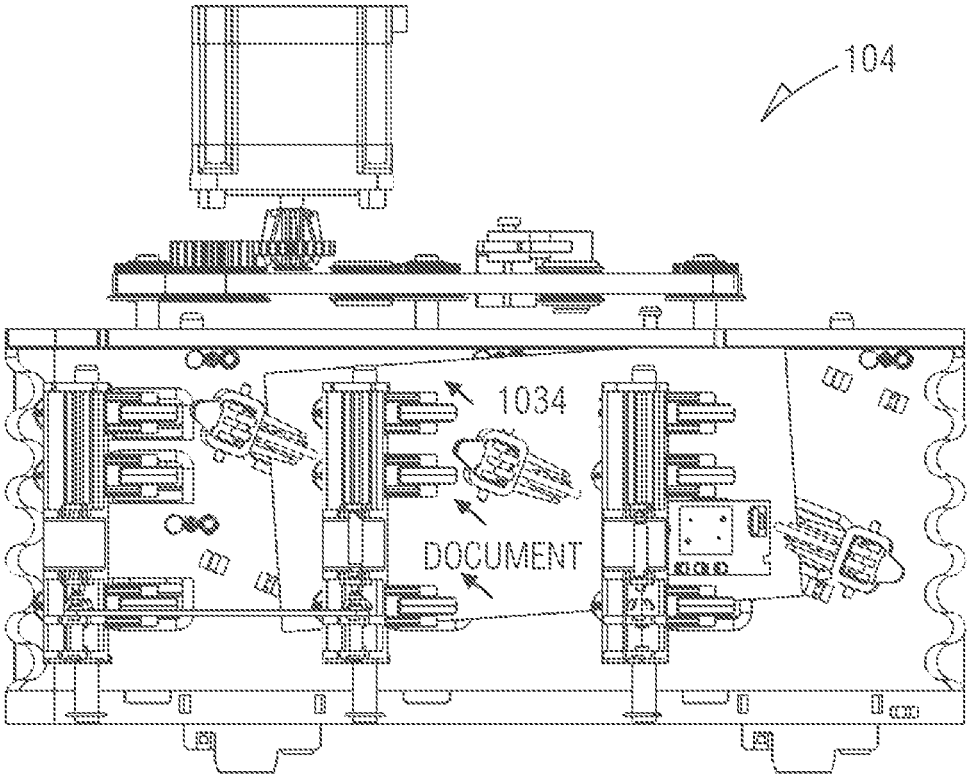
FIG. 1F is a diagram depicting the media fully received by the deskew module, according to an example embodiment.

FIG. 1F is now discussed with the present illustration being continued.

FIG. 1F is a diagram depicting the media fully received by the deskew module, according to an example embodiment.

The activation of the angle idlers 104C2-C3 forces the angle idlers 104C2-C3 on top of the document 104H along the leading portion of the document 104H (leading based on that portion of the document that is farthest within the deskew module 104) this pulls the leading portion of the document through the deskew module 104 in the direction of the angle idlers 104C2-C3. Simultaneously, in cell 104F the angle idler 104C1 is active pushing the trailing portion of the document 104H (trailing based on that portion of the document that is closest to the entry point of the deskew module 104) in an angled direction through the deskew module 104.

Because the angle idlers 104C2-C3 are activated the trailing portion of the document 104H is being held down. This causes the document 104H to begin to turn and orient along its topmost edge against a topmost edge of the deskew module 104H as shown fully completed in the FIG. 1G.

Figure 1G:
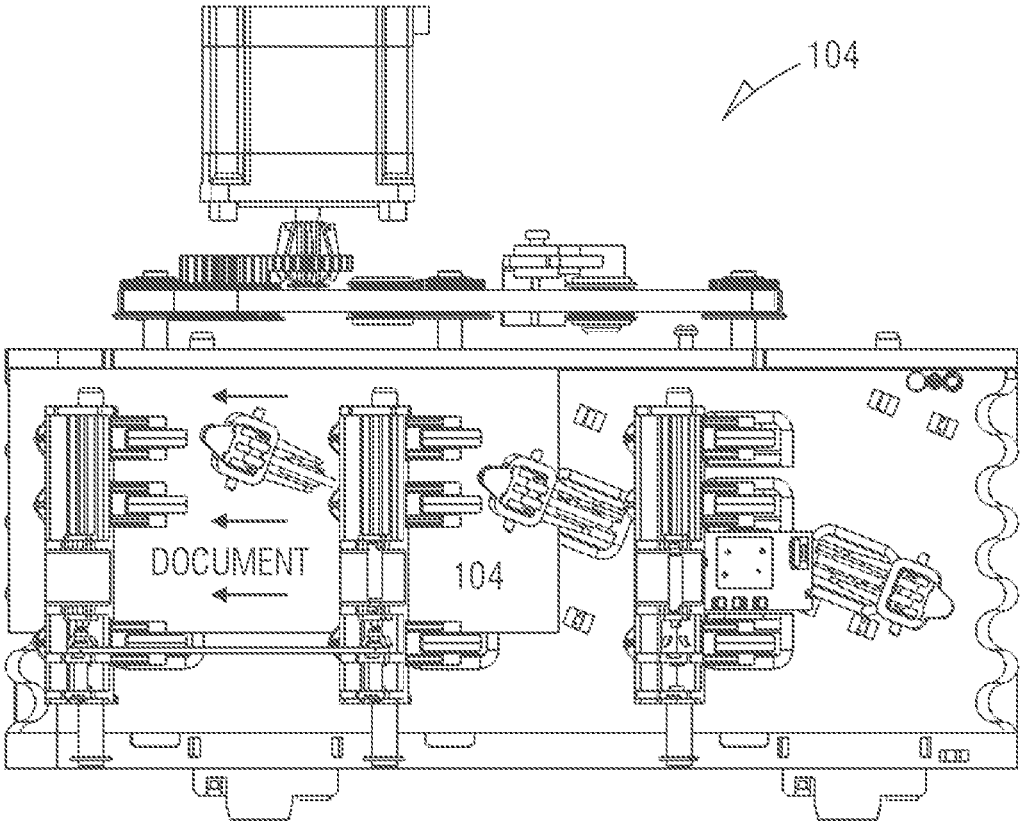
FIG. 1G is a diagram depicting the media fully deskewed within the deskew module, according to an example embodiment.

FIG. 1G is a diagram depicting the media fully deskewed within the deskew module 104, according to an example embodiment.

The simultaneous and selective activation of the angle/straight idlers 104C1/104D1 in cell 104F and the angle/straight idlers 104C1-C2/104D2-D3 in cell 104G causes the document 104H to turn and/or orient itself along the topmost edge of the deskew module 104. At this, the controller receives readings from the three deskew sensors 104B, which indicates the document 104H is aligned and deskewed along a topmost edge of the deskew module 104 and the controller causes the document 104H to be ejected back onto the pathway 102 to the imagers 106 and/or MICR reader 107.

When the readings received by the controller from the deskew sensors 104B indicate that the document is not deskewed properly. The controller dynamically places the deskew module 104 in a retry or backup mode of operation. This is an indication that the document 104H may have folded in some manner along the topmost edge of the deskew module 104 or is not oriented as it should be completely along the topmost edge of the deskew module 104.

In the retry mode of operation, the controller selectively and simultaneously activates the angle idlers 104C2-C3 in cell 104G and the straight idler 104D1 in cell 104F and reverses the direction of these idlers 104C2-C3 and 104D1 such that the document 104H is now being pushed and pulled in the direction of the entry point of the deskew module 104 (in the direction of the separator 103 and away from the imagers 106 and/or the MICR reader 107). This lifts up an upper surface (the surface facing opposite the track datum 104A) of the document 104H along the topmost edge (top and closest to an exit) of the deskew module 104 and causes the document to slightly reorient. When the leading edge (as defined above) of the document reaches a specific sensor new the entry point of the deskew module 104, the controller reverses the direction of all angle/straight idlers 104C1-C3 and 104D1-D3 to put the deskew module 104 back in the damage media mode of operation, and document handling within the deskew module 104 proceeds in another iteration of what was discussed above in the FIGS. 1D-1G.

The techniques discussed above for selective activation of the idlers 104C and 104D within the cells 104F and 104G during a damage media mode and retry mode for the deskew module 104 (as dynamically determined, activated, and driven by the novel controller) permits more effective document 104H deskewing and allows the document 104H to pivot for alignment or pivot for a retry of an alignment in a more efficient and optimal manner than conventional approaches to document deskewing.

With the various componentry of a novel deskew module 104 presented, the programmed processing of the controller within a mother board interfaced to the componentry is now discussed with reference to the FIGS. 1H and 2-4.

Figure 1H:
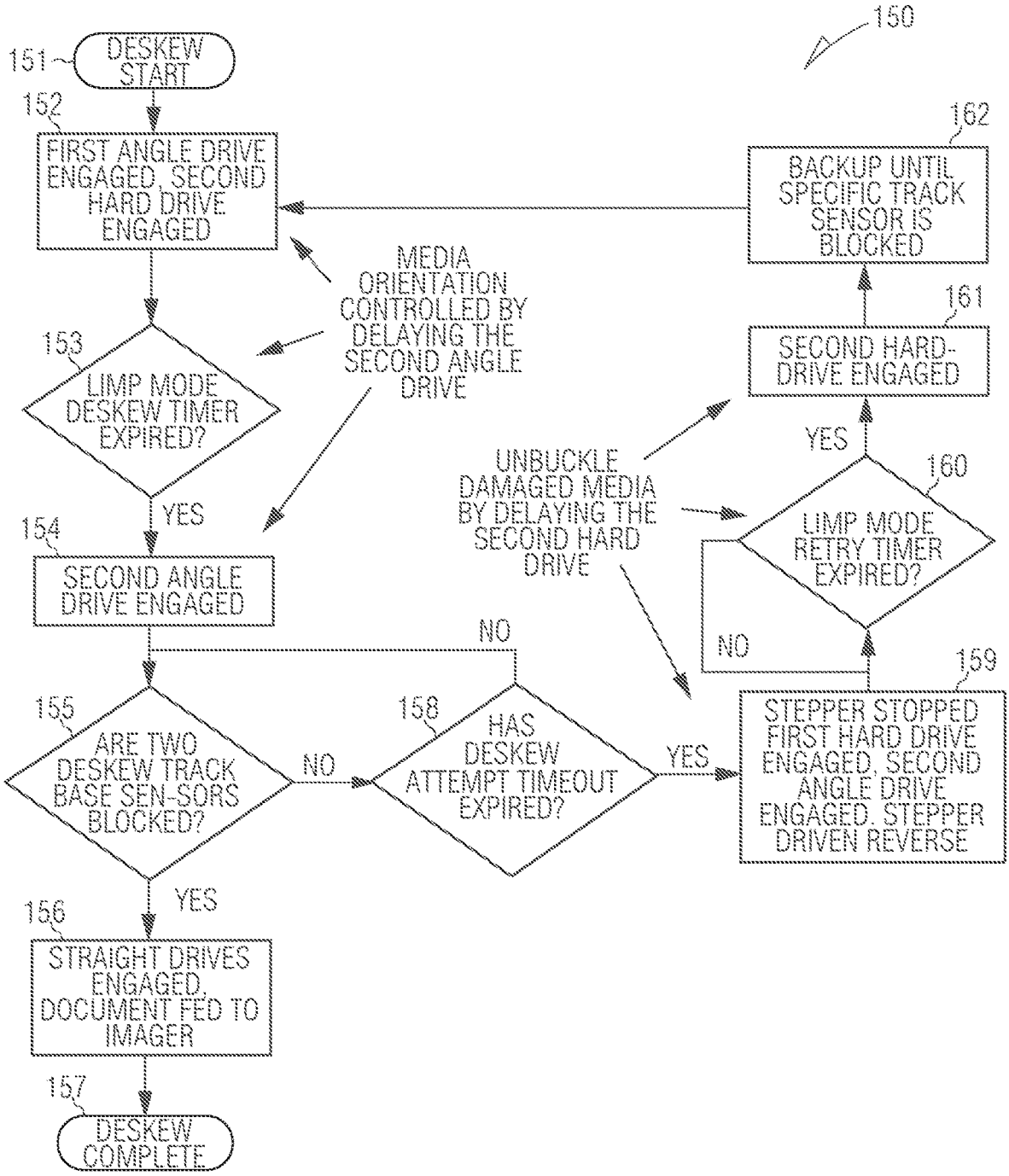
FIG. 1H is a diagram of a method for deskewing media by a deskew module, according to an example embodiment.

FIG. 1H is a diagram of a method 150 for deskewing media by a deskew module, according to an example embodiment. The method 150 is implemented as firmware instructions programmed and loaded into a motherboard that is connected to the deskew module 104 through electronic componentry (such as an electronic circuit board). The firmware instructions reside within a non-transitory medium on modules interfaced to the motherboard (memory module (s) and/or storage module(s)). One or more processors of the motherboard execute the firmware instructions. The method 150 is herein referred to as a controller.

The controller selectively and dynamically activates the deskew module 104 to operate in a normal mode of operation, a damaged media mode of operation, and a retry mode of operation (as discussed above with the FIGS. 1B-1G. However, just the damaged media mode and retry mode of operation is illustrated in the method 150. The mechanism for the controller to determine whether to processing in normal mode or damaged media mode was discussed above in the FIGS. 1C-1G (based on the length of the document being handled within the deskew module 104). Also, it is noted that "damaged media mode" and "deskew mode" may be used synonymously herein with the discussion of the method 150 for the controller.

At 151, the controller has determined to activate the deskew module 104 in a deskew mode of operation.

At 152, the controller engages (activates) a first angled drive (angled drive idler 104C1 in cell 104F) within the deskew module 104 with engagement of a second hard drive and a third hard drive (straight drive idlers 104D2-D3 in cell 104G).

At 153, the controller checks to see whether a time set for deskewing has expired or not.

At 154, the controller determines that the timer set in 153 has expired and engages second and third angled drives (angle drive idlers 104C2 and 104C3 in cell 104G).

At 155, the controller checks to determine if two tracked-based sensors are blocked (indicating the document is fully deskewed within the deskew module 104).

At 156, the controller determines that the two tracked-based sensors are blocked and the straight drivers (104D1-D3 in cells 104F and 104G) are engaged to eject the document from the deskew module 104 for feeding to images 106 and/or MICR reader 107.

At 157, the controller is stopped and deskewing is fully completed.

At 158, the controller determines that the two tracked-based sensors are not blocked by the document, indicating the document has not been deskewed properly within the deskew module 104.

At 159, the controller initiates a retry mode of operation for the deskew module 104 by engaging the first hard drive (straight drive idler 104D1 in cell 104F) and engaging the second and third angle drives (angle drive idlers 104C2-C3 in cell 104G) and the stepper motor 104E is reversed to reverse the direction of the document path towards the entry point of the deskew module 104.

At 160, the controller checks to see whether a retry timer has expired, and if not, the processing at 159 continues. Once, the retry time has expired, at 161, the controller engages the second hard drives (straight drive idlers 104D2-D3 in cell 104G.

At 162, the controller waits for a specific track sensor to be detected as being blocked by the document when it has, the controller activates another iteration of the deskew mode of operation at 152.

These and other embodiments are now discussed with reference to the FIGS. 2-4, with respect to the valuable media dispenser 100, the deskew module 104, and the controller.

Figure 2:
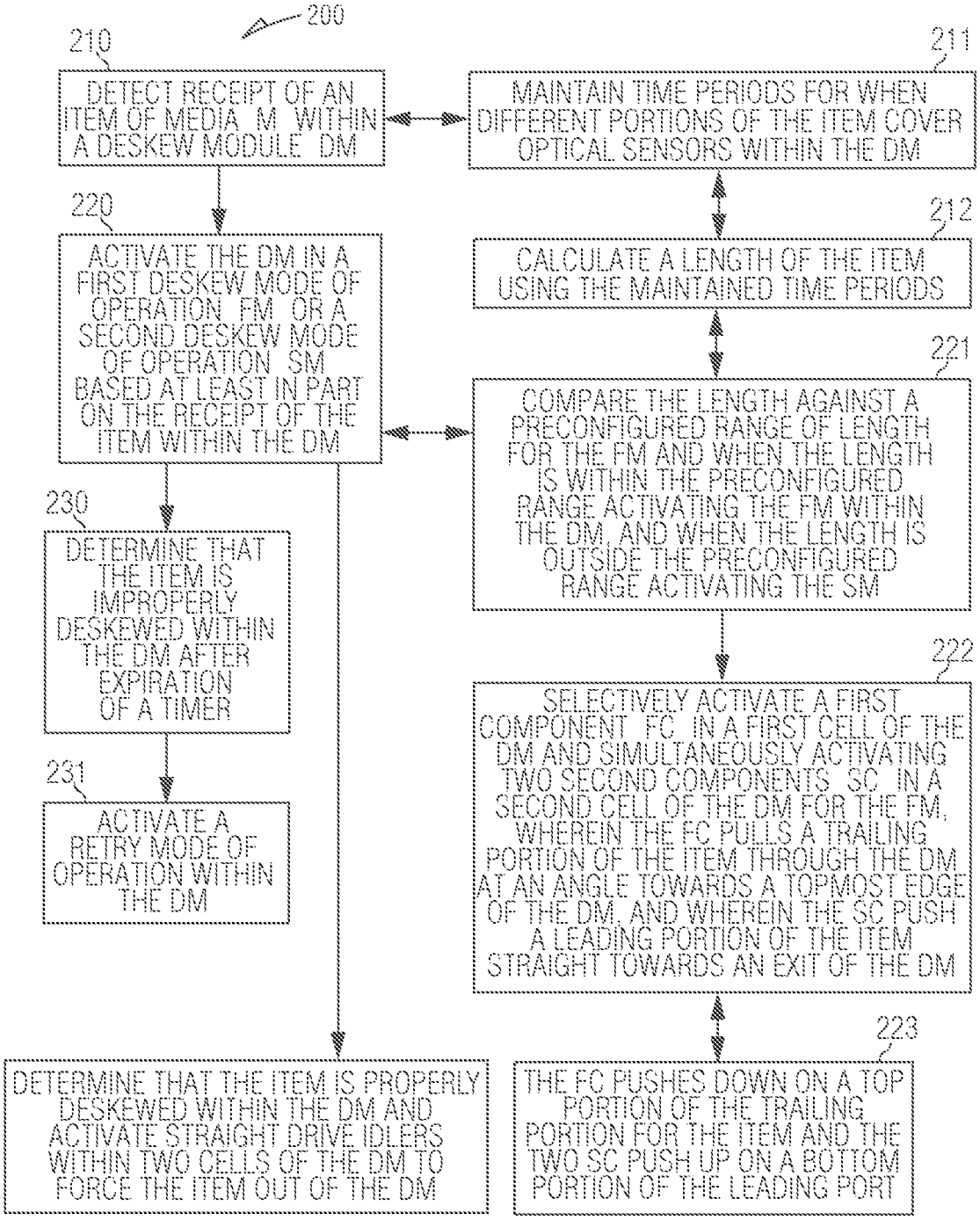
FIG. 2 is a diagram of a method for deskewing media, according to an example embodiment.

FIG. 2 is a diagram of a method 200 for deskewing media within a media depository, according to an example embodiment. The method 200 when processed controls modes of operation for a deskew module integrated into a valuable media depository. The method 200 is implemented as executed instructions representing one or more software modules referred to as a mode activation manager. The instructions reside in a non-transitory computer-readable medium and are executed by one or more processors of the valuable media depository.

In an embodiment, the mode activation manager is executed by one or more processors of the valuable media depository 100.

In an embodiment, the media depository is a deposit module.

In an embodiment, the media depository is a recycler module.

In an embodiment, the media depository is a peripheral device integrated into an SST. In an embodiment, the SST is an ATM. In an embodiment, the SST is a kiosk.

In an embodiment, the media depository is a peripheral device integrated into a Point-Of-Sale (POS) terminal.

In an embodiment, the mode activation manager is the controller discussed above with the FIGS. 1B-1H.

At 210, mode activation manager detects receipt of an item of media (valuable media as defined above) within a deskew module (deskew module 104).

According to an embodiment, at 211, the mode activation manager maintains time periods for when different portion of the item of media cover optical sensors within the deskew module 104.

In an embodiment of 211 and 212, the mode activation manager calculates a length of the item using the maintained time periods.

At 220, the mode activation manager activates the deskew module 104 in a first deskew mode of operation or a second deskew mode of operation based at least in part on receipt of the item within the deskew module 104.

In an embodiment of 212 and 220, at 221, the mode activation manager compares the calculated length for the item of media against a preconfigured range of length for the first deskew mode of operation. When the length is within the preconfigured range, the mode activation manager, activates the deskew module 104 in the first deskew mode of operation, and when the length is outside the preconfigured range, the mode activation manager activates the deskew module 104 in the second mode of operation.

In an embodiment of 221 and at 222, the mode activation manager selectively activates a first component (such as angled drive idler 104C1) in a first cell (such as cell 104F) of the deskew module 104 and simultaneously activates two second component (such as straight drive idlers 104D2-D3 in a second cell (such as cell 104G) of the deskew module 104 for the first deskew mode of operation. The first component pulls a trailing portion of the item through the deskew module 104 at an angle towards a topmost edge of the deskew module 104 and towards an exit of the deskew module 104, and the two second components push a leading portion of the item straight towards the exit of the deskew module 104.

In an embodiment of 222 and at 223, the first component pushes down on a top portion of the trailing portion for the item and the two second component push up on a bottom portion of the leading portion for the item.

According to an embodiment, at 230, the mode activation manager determines that the item is improperly deskewed within the deskew module 104 after expiration of a timer and based on readings from one or more deskew sensors within the deskew module 104.

In an embodiment of 230 and at 231, the mode activation manager activates a retry mode of operation within the deskew module 104.

In an embodiment, at 240, the mode activation manager determines that the item is properly deskewed within the deskew module 104 and activates two straight drive idlers within two cells of the deskew module 104 to force the item out an exit of the deskew module 104.

Figure 3:
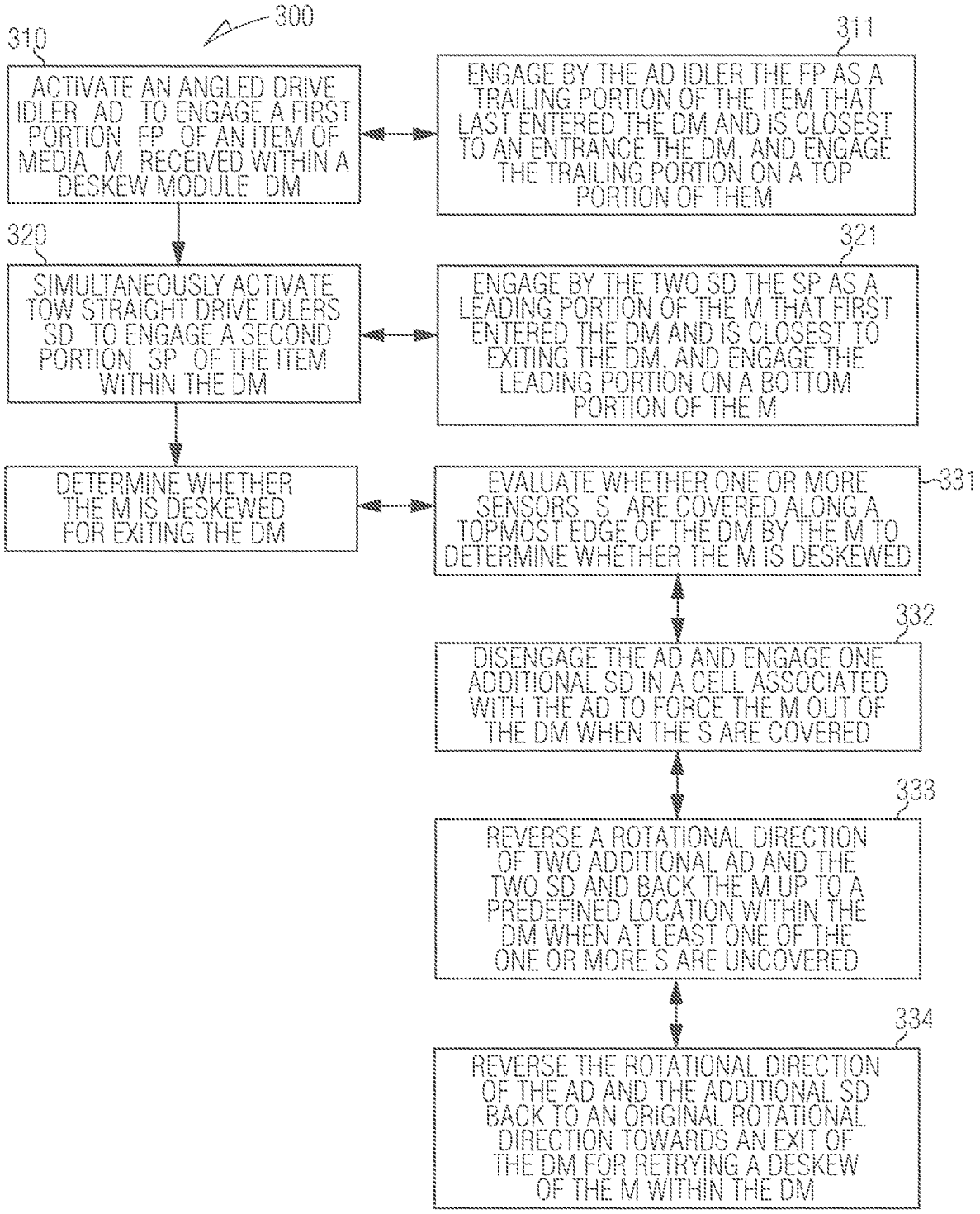
FIG. 3 is a diagram of another method for deskewing media, according to an example embodiment.

FIG. 3 is a diagram of another method 300 for deskewing media within a media depository, according to an example embodiment. The method 200 when processed controls modes of operation for a deskew module integrated into a valuable media depository. The method 200 is implemented as executed instructions representing one or more software modules referred to as a deskew controller. The instructions reside in a non-transitory computer-readable medium and are executed by one or more processors of the valuable media depository.

In an embodiment, the deskew controller is executed by one or more processors of the valuable media depository 100.

In an embodiment, the media depository is a deposit module.

In an embodiment, the media depository is a recycler module.

In an embodiment, the media depository is a peripheral device integrated into an SST. In an embodiment, the SST is an ATM. In an embodiment, the SST is a kiosk.

In an embodiment, the media depository is a peripheral device integrated into a Point-Of-Sale (POS) terminal.

In an embodiment, the deskew controller is the controller and/or the mode activation manager discussed above with the FIGS. 1B-1H and the FIG. 2.

In an embodiment, the deskew controller presents another and in some ways enhance perspective of the processing depicted in the method 200 (presented above with the discussion of the FIG. 2 and the mode activation manager).

At 310, the deskew controller activates an angled drive idler (such as angled drive idler 104C3 in cell 104F) to engage with a first portion of an item of media received with a deskew module 104.

In an embodiment, at 311, the angled drive idler engages the first portion as a leading portion of the item that first entered the deskew module 104 and is closest to exiting the deskew module 104. The angled drive idler also engages the leading portion on a top portion of the item.

At 320, the deskew controller simultaneously (simultaneous to the processing of 310) activates two straight drive idlers (such as straight drive idlers 104D2-D3) to engage a second portion of the item within the deskew module 104.

In an embodiment, at 321, the straight drive idler engages the second portion as a trailing portion of the item that last entered the deskew module 104 and is closest to an entry point of the deskew module 104. The two straight drive idlers also engages the trailing portion on a bottom portion of the item.

At 330, the deskew controller determines whether the item is deskewed for exiting the deskew module 104.

In an embodiment, at 331, the deskew controller evaluates whether one or more optical sensors are covered along a topmost edge of the deskew module 104 by the item to determine whether the item is deskewed.

In an embodiment of 331 and at 332, the deskew controller disengages the angled drive idler and engages an additional straight drive idler (such as straight drive idlers 104D1) in a cell (such as cell 104F) associated with the angled drive idler (such as angled drive idler 104C1) to force the item out of the deskew module 104 when the one or more sensors are covered.

In an embodiment of 332 and at 333, the deskew controller reverses a rotational direction of two additional angled drive idlers (14C2-C3 in cell 104G) and one additional straight drive idler (104D1 in cell 104F) and backs the item up to a predefined location within the deskew module 104 when at least one of the one or more sensors are uncovered (indicating the item was improperly deskewed within the deskew module 104).

In an embodiment, at 334, the deskew controller reverses the rotational direction of the angled drive idler and the two straight drive idlers back to an original rotational direction towards an exit of the deskew module 104 for retrying a deskew of the item within the deskew module 104 (retrying the deskew processing discussed at 310-321).

Figure 4:
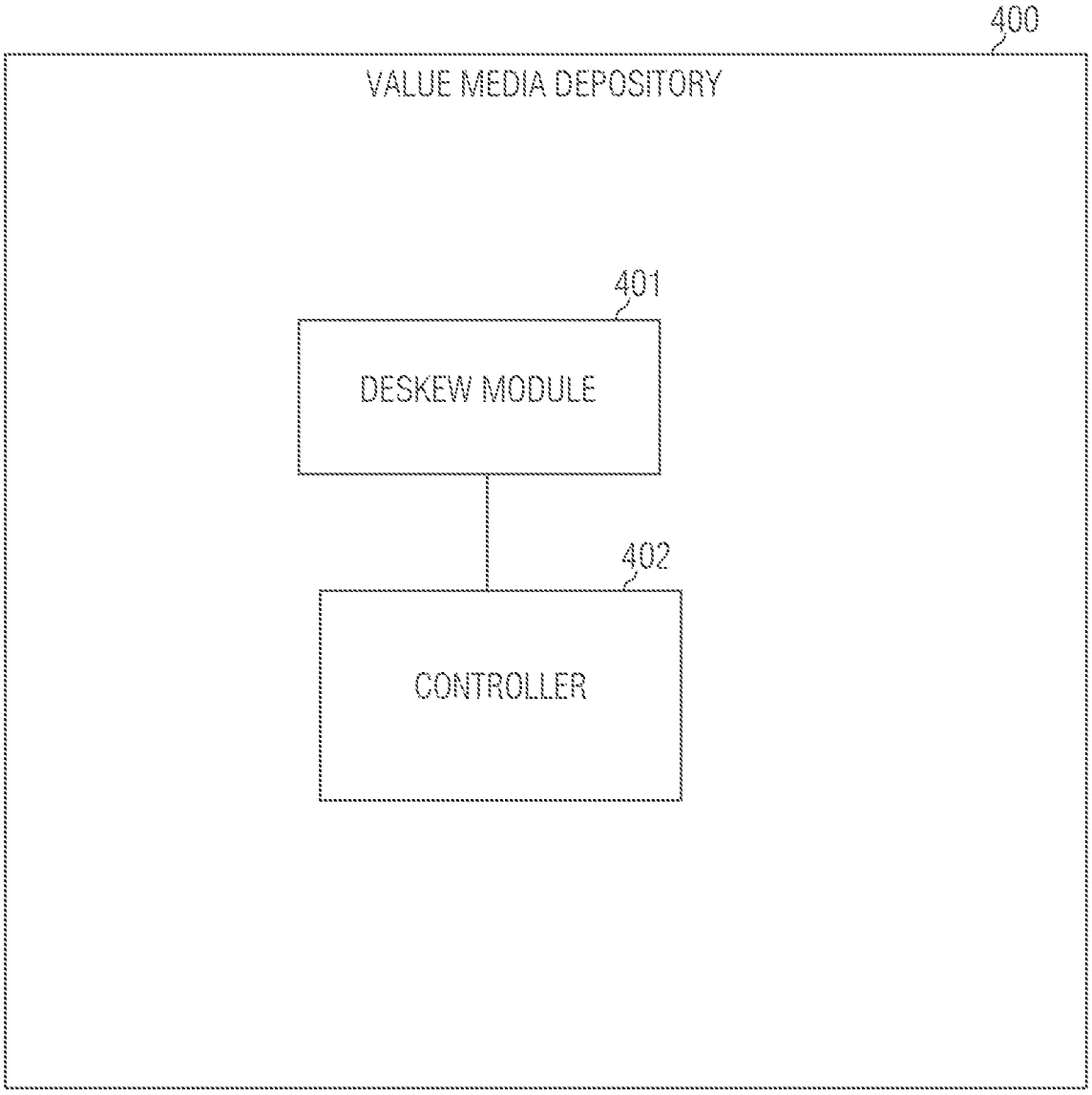
FIG. 4 is a media depository, according to an example embodiment.

FIG. 4 is a media depository 400 with a deskew module, according to an example embodiment. The valuable media depository 400 processes valuable media and includes a variety of mechanical, electrical, and software/firmware components, some of which were discussed above with reference to the FIGS. 1A-1H and the FIGS. 2-3.

In an embodiment, the valuable media depository 400 is a deposit module.

In an embodiment, the valuable media depository 400 is a recycler module.

In an embodiment, the valuable media depository 400 is the depository 100.

In an embodiment, the valuable media depository 400 is the depository that performs any of the methods 150, 200, and 300 of the FIGS. 1H and 2-3.

In an embodiment, the valuable media depository 400 is a peripheral device integrated into an SST. In an embodiment, the SST is an ATM. In an embodiment, the SST is a kiosk.

In an embodiment, the valuable media depository 400 is a peripheral device integrated into a Point-Of-Sale (POS) terminal.

The valuable media depository 400 includes a deskew module 401 including a media transport and a controller 402 operable to control the deskew module 401.

The deskew module 401 is configured to deskew items of media (valuable media) being transported through the depository 400.

In an embodiment, the deskew module 401 is the deskew module 104.

The controller 402 is configured to dynamically and selectively activate mechanical components of the deskew module 401 in a first mode of operation for deskewing items of media and in an event that the first mode is unsuccessful at deskewing a particular media item, the controller 402 is further configured to reverse the media transport and then activate the mechanical components of the deskew module 402 is a second mode of deskewing operations.

In an embodiment, the controller 402 is further configured to dynamically determine the first mode from a selection of a currency mode and a check mode based on dynamically determined lengths for each of the items.

In an embodiment (of the latter embodiment), the controller 402 is further configured to selectively reverse a rotational direction of the mechanical components (when the deskewing was unsuccessful) to retry a selected mode of deskewing operation when any of the items of media is determined to be improperly deskewed within the deskew module 401.

In an embodiment, the controller 402 drives the electromechanical components of the deskew module 104 as discussed in the FIGS. 1B-1H and the FIGS. 2-3.

In an embodiment, there is provided a media depository comprising: a deskew module including a straight drive and an angled drive; and a controller 402 operable to control the deskew module; wherein the controller 402 is configured to deskew items of media being transported through the depository by activating the straight drive until a trailing portion of a media item engages with the angled drive and then activating the angled drive to more the trailing portion of the media time such that the media item pivots about a central portion thereof.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A method, comprising:

detecting receipt of an item of media within a deskew module;

activating the deskew module in a first deskew mode of operation based at least in part on the receipt of the item within the deskew module, wherein the deskew module includes two cells, a first cell includes a first angled drive idler and a first straight drive idler, and a second cell includes second and third angled drive idlers and second and third straight drive idlers, wherein activating further includes activating for the first deskew mode of operation includes activating the first angled drive idler in the first cell and activating the second and third straight drive idlers in the second cell with the first straight drive idler of the first cell deactivated and the second and third angled drive idlers of the second cell deactivated, wherein each of the angled drive idlers, in the first cell and the second cell, urge the item of media at an angle that is less than 180 degrees through the deskew module when activated, and wherein each of the straight drive idlers, in the first cell and the second cell, urge the item of media through the deskew module in a straight line at 180 degrees when activated, wherein activating further includes performing the first mode of operation based on a dynamic determination for a calculated length associated with the item of media and calculating the calculated length associated with the item of media by timing when three deskew sensors of the deskew module indicate that the three deskew sensors are covered and uncovered as the item of media passes through the deskew module and comparing the calculated length to ranges of lengths when determining to perform the first mode of operation;

determining that the item is properly deskewed within the deskew module and activating first, second, and third straight drive idlers within the first and second cells of the deskew module to force the item out of the deskew module.

2. The method of claim 1, wherein activating further includes determining that the item is improperly deskewed within the deskew module after expiration of a timer.

3. The method of claim 2, wherein determining further includes activating a retry mode of operation within the deskew module.

4. The method of claim 1, wherein detecting further includes maintaining time periods for when different portions of the item cover the three deskew sensors within the deskew module.

5. The method of claim 4, wherein maintaining further includes calculating the calculated length of the item using the maintained time periods.

6. The method of claim 5, wherein activating further includes activating the deskew module for the first deskew mode of operation by comparing the calculated length against a preconfigured range of length for the first deskew mode of operation and when the calculated length is within the preconfigured range activating the deskew module in the first deskew mode of operation indicating the item of media is a currency note, and activating the deskew module in a second deskew mode of operation when the calculated length is outside the preconfigured range indicating the item of media is a check.

* * * * *